United States Patent [19]

Bywater

[11] 3,945,329

[45] Mar. 23, 1976

[54] WATER BARRIER FOR FLOOR SAFES OR THE LIKE

[76] Inventor: Alan W. Bywater, 1181 Aquamarine Lane, Corona, Calif. 91720

[22] Filed: May 19, 1975

[21] Appl. No.: 578,519

[52] U.S. Cl. ..... 109/68; 49/463; 109/75

[51] Int. Cl.[2] ..... E05G 1/026

[58] Field of Search ..... 109/50, 58, 58.5, 64, 67, 109/68, 75; 49/463, 465; 220/256, 356, 357

[56] References Cited

UNITED STATES PATENTS

| | | | |
|---|---|---|---|
| 1,887,866 | 11/1932 | Belknap | 109/68 X |
| 2,226,233 | 12/1940 | Shapiro | 220/256 X |
| 2,908,417 | 10/1959 | Conner et al. | 220/256 X |
| 2,935,955 | 5/1960 | Mann | 109/68 X |
| 3,747,541 | 7/1973 | Reese | 109/50 |

FOREIGN PATENTS OR APPLICATIONS

| | | | |
|---|---|---|---|
| 620,697 | 4/1927 | France | 109/50 |

*Primary Examiner*—Paul R. Gilliam
*Assistant Examiner*—David H. Corbin
*Attorney, Agent, or Firm*—Fred N. Schwend

[57] ABSTRACT

A water barrier for floor safes comprising a removable lid having an elastomeric sealing O-ring extending around the periphery of a relatively rigid rim thereof to engage the inner surface of the case of a floor safe, the lid having a hollow central knob which facilitates removal of the lid and which extends over the safe door lock. The portion of the lid within the peripheral rim is relatively flexible whereby to flex in response to changes in atmospheric pressure against the lid.

10 Claims, 3 Drawing Figures

FIG. 2.
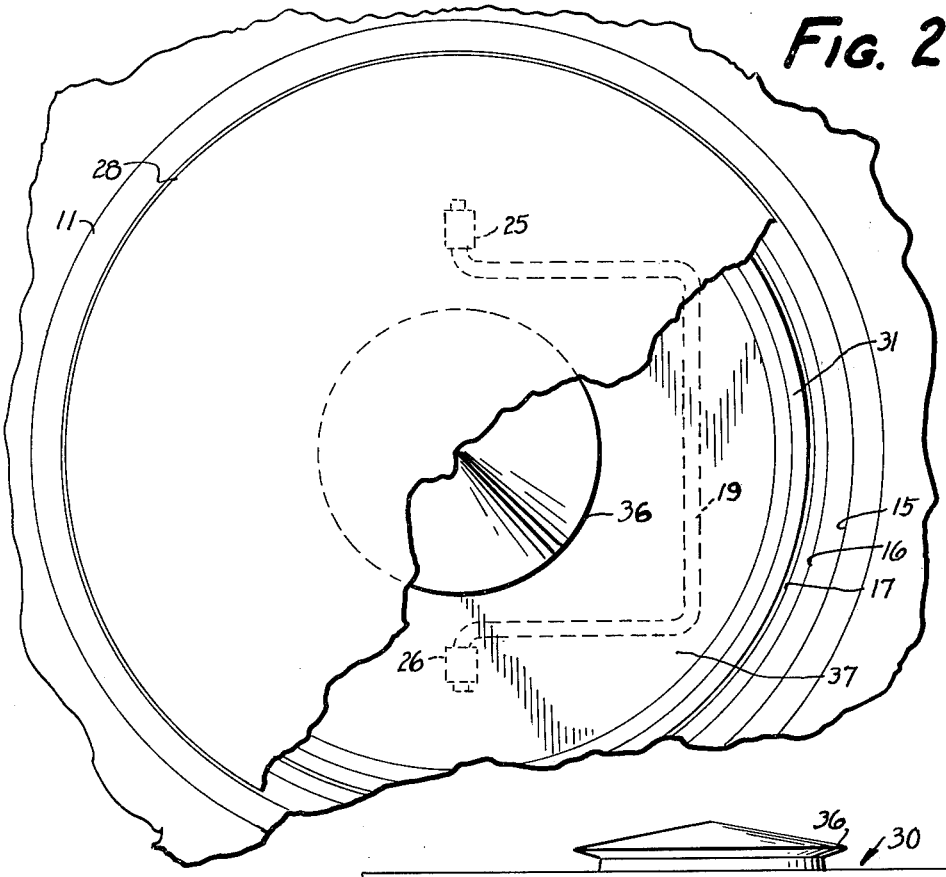
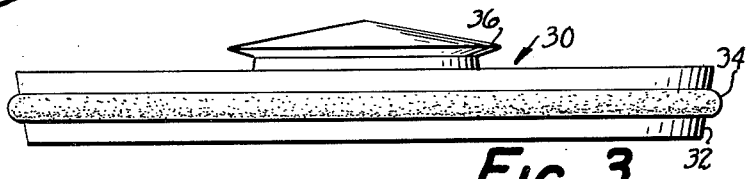
FIG. 3.
FIG. 1.
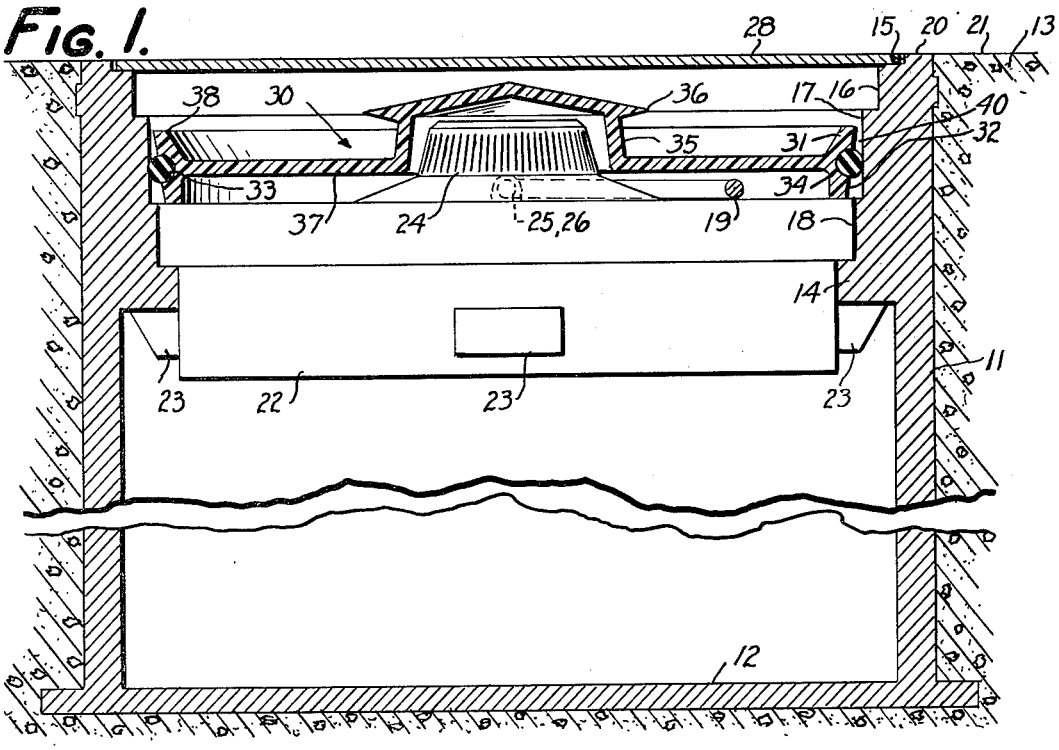

WATER BARRIER FOR FLOOR SAFES OR THE LIKE

BACKGROUND OF THE INVENTION

1. Field of the Invention

This invention relates to floor safes or the like and has particular reference to means for preventing the seepage of water or other liquids into the safe.

2. Description of the Prior Art

Floor safes have long been used, particularly in stores, garages, service stations, etc. to store and protect money and other valuables against burglarization and fire. They are particularly desirable since they are normally embedded in a concrete floor, making it extremely difficult to break into or remove such a safe. Also, in the event of a fire, the surrounding concrete tends to prevent excessive temperature changes to be transmitted to the contents of the safe.

Floor safes generally comprise a vertical metal case having a normally locked, removable door which is secured within the case somewhat below the level of the floor. A dust cover plate which is removably mounted on the top of the case and flush with the top surface of the floor to form a continuous floor surface over the safe and to exclude dust and dirt from falling onto the door.

Such floor safes are generally satisfactory. However, it if often desirable to wash down the surrounding floor surface, particularly in service stations, garages, etc., and at other times, water may run over or flood such floors, resulting in the water seeping past the dust cover plate, past the safe door and into the interior of the safe with the obvious possibility of damaging or destroying the contents.

STATEMENT OF THE INVENTION

A principal object of the present invention is to provide a removable barrier to prevent water or other liquids from seeping into the interior of a floor safe.

Another object is to provide a removable water barrier which may be used in existing floor safes.

Another object is to overcome the effects of changing atmospheric pressure on a water barrier of the above type.

A further object is to provide a simple and economically manufactured water barrier for floor safes.

According to the invention, a simple and economically manufactured water barrier is provided which may be used in existing as well as in new floor safes or the like and comprises a lid, preferably of plastic, having an elastomeric sealing ring extending around a peripheral rim thereof and engaging the inner wall of the safe. An upwardly extending hollow knob is formed in the center of the lid to facilitate removal and replacement of the lid. Such knob encompasses the usual locking means provided on the door so that the lid takes up a minimum amount of space and will thus fit between existing safe doors and the overlying dust cover plates.

The portion of the lid intermediate the knob and the periphery is formed in a flat plane and is depressed to accumulate any liquid which might seep down the inner wall of the safe. Such depressed portion is of sufficient flexibility to flex in response to changes in atmospheric pressure so as to reduce the tendency for such pressure to bodily shift the lid.

BRIEF DESCRIPTION OF THE DRAWINGS

The manner in which the above and other objects of the invention are accomplished will be readily understood on reference to the following specification when read in conjunction with the accompanying drawings wherein:

FIG. 1 is a sectional view through a floor safe and a water barrier embodying a preferred form of the present invention.

FIG. 2 is a plan view of the safe with part of the cover plate broken away.

FIG. 3 is a side view of the water barrier lid.

DESCRIPTION OF THE PREFERRED EMBODIMENT

Referring to the drawings, the floor safe in which the present invention is embodied, comprises a cylindrical metal case 11 which is closed at its lower end at 12 and is embedded in a concrete floor 13. The case has an inwardly extending annular flange 14 near its upper end and a series of stepped counterbores 15, 16, 17 and 18 therein located above the flange 14. The upper end 20 of the case 11 preferably extends flush with the upper surface 21 of the floor 13.

A removable cylindrical safe door 22 is slideably fitted within the counterbore 18 and rests on the annular flange 14. A series of retractable lock bolts 23 are carried by the door 22 and normally project under the flange 14 to lock the door in place.

A combination lock, including a combined rotational dial and knob 24, is mounted on the door 22 centrally thereof. When the knob 24 is turned to the proper combination of dial settings, the lock is effective to retract the bolts 23 within the door to permit withdrawal of the door. To facilitate removal or replacement of the door 22, a bail type handle 19 is pivotally mounted thereon at 25 and 26 and normally lays against the upper surface of the door.

A flat removable dust cover plate 28 normally rests within the upper counterbore 15 and extends flush with the floor surface 21 to present an unbroken floor surface over the safe. Such plate 28 also excludes dust and dirt and small objects from falling onto the door 22.

According to the present invention, a water barrier lid, generally indicated at 30, is provided to prevent water or other liquids from seeping down past a cover plate 28 and onto or past the door 22. The lid 30 normally fits within the counterbore 17 and is preferably formed of a generally flexible plastic such as polyethene or polypropylene. The lid 30 has an outer relatively rigid rim 31 with a frusto-conical outer surface 32 which converges downwardly. The rim 31 may rest on the upper surface of the door 22. A circumferentially extending groove 33 is formed in the rim 31 to receive an elastomeric O-ring 34. The latter sealingly engages the inner surface of the counterbore 17 when the lid 30 is in place.

A hollow upwardly extending knob 35 is formed centrally of the lid 30 and an outwardly extending flange 36 is formed thereon to permit gripping the same to remove or replace the lid 30.

The portion 37 of the lid 30 intermediate the knob 35 and rim 31 is flat and is depressed below the level of the upper edge 38 of the rim 31. Such portion 37 is preferably on the order of .125 inches thick so as to be flexible enough to flex up and down as the atmospheric pressure above the lid changes relative to that existing within the safe, thus reducing the possibility of atmospheric pressure bodily shifting the lid.

In the event that water or other liquids seep past the cover 28 due to washing or flooding the floor surface 21 and passes along the inner surface of the case 11, it will be arrested by the sealing ring 34 and will fill the minute crevice 40 existing between the O-ring 34 and the upper edge 38 of the rim 31. As further water seeps in, it will overflow the rim 31 and will accumulate over the depressed portion 37 from which it can be safely removed after the lid 30 is removed from the safe.

The frusto-conical surface 32 of rim 31 facilitates centering of the lid during replacement thereof over the safe door 22.

Having thus described the invention, it is not intended that it be so limited since changes may be made therein without departing from the scope of the invention. Accordingly, it is intended that the subject matter described above and shown in the drawings be interpreted as illustrative only and not in a limiting sense.

I claim:

1. A liquid barrier for a floor safe or the like having
a cylindrical case,
a lockable door removably mounted in the said case,
said door having a lock means thereon,
comprising
a removable lid fitted in said case above said door,
said lid having an elastomeric sealing ring around the periphery thereof and extending in sealing engagement with the inner surface of said case, and
means on said lid forming a hollow upwardly extending knob to facilitate removal and replacement of said lid,
the underportion of said knob at least partly encompassing said lock means, and
the portion of said lid between said knob and said periphery being depressed whereby to accumulate liquid.

2. A liquid barrier according to claim 1 wherein the portion of said lid within said periphery is flexible whereby to flex in response to atmospheric pressure against said lid.

3. A liquid barrier as defined in claim 1 wherein said knob is located centrally of said lid and said depressed portion surrounds said knob.

4. A liquid barrier as defined in claim 3 wherein said depressed portion is flexible whereby to flex in response to atmospheric pressure against said lid.

5. A liquid barrier as defined in claim 1 wherein said periphery is relatively rigid and the portion of said lid within said periphery is relatively flexible whereby to flex in response to atmospheric pressure against said lid.

6. A liquid barrier for floor safes or the like having
a cylindrical case,
a door removably mounted in the upper end of said case,
said door having lock means thereon, and
a cover plate removably mounted on said case above said door,
comprising
a removable lid intermediate said door and said cover plate,
said lid having a circumferentially extending groove around the periphery thereof,
an elastomeric sealing ring in said groove and extending in sealing engagement with the inner surface of said case, and
means on said lid forming a handle to facilitate removal and replacement of said lid,
a portion of said lid within said periphery being depressed whereby to accumulate liquid.

7. A liquid barrier as defined in claim 6 wherein said handle means comprises
a hollow upwardly extending knob,
the under portion of said knob at least partly encompassing said lock means.

8. A liquid barrier according to claim 6 wherein said lock means and said knob are located centrally of said lid and said depressed portion surrounds said knob.

9. A liquid barrier as defined in claim 5 wherein the surface of said periphery is frusto-conical and converges downwardly.

10. A liquid barrier as defined in claim 7 wherein said depressed portion is flexible whereby to flex in response to atmospheric pressure against said lid.

* * * * *